United States Patent [19]

Zeiss et al.

[11] Patent Number: 5,077,080

[45] Date of Patent: Dec. 31, 1991

[54] PROCESS FOR PRODUCING AND PROCESSING MULTI-COMPONENT MIXTURES ON THE BASIS OF REACTION PLASTICS

[75] Inventors: Karl R. Zeiss, Freiburg; Paul Degen, Buhlertal, both of Fed. Rep. of Germany

[73] Assignee: Messer Griesheim GmbH, Fed. Rep. of Germany

[21] Appl. No.: 456,747

[22] Filed: Dec. 26, 1989

[51] Int. Cl.[5] ..... B05D 1/04

[52] U.S. Cl. ..... 427/11; 427/195; 427/374.2; 427/374.4; 427/375; 427/398.3; 264/5; 264/28

[58] Field of Search ..... 427/11, 189, 195, 374.2, 427/374.4, 358, 180, 375, 398.2, 398.3, 398.4; 264/5, 28

[56] References Cited

U.S. PATENT DOCUMENTS

| | | | |
|---|---|---|---|
| 3,226,245 | 12/1965 | Dettling et al. | 427/195 |
| 3,236,788 | 2/1966 | Smith-Johannsen | 427/195 |
| 3,446,642 | 5/1969 | Webb | 427/195 |
| 3,450,571 | 6/1969 | Zenczak | 427/11 |
| 3,551,184 | 12/1970 | Dremann et al. | 427/11 |
| 4,051,275 | 9/1977 | Forestek | 427/201 |
| 4,113,684 | 9/1978 | Petrie | 427/195 |
| 4,196,236 | 4/1980 | Lundberg et al. | 427/374 |
| 4,811,818 | 3/1989 | Jamison | 427/11 |
| 4,978,575 | 12/1990 | Zeiss | 428/402 |

FOREIGN PATENT DOCUMENTS 338983 1/1930 United Kingdom .

*Primary Examiner*—Michael Lusignan
*Assistant Examiner*—Diana L. Dudash
*Attorney, Agent, or Firm*—Connolly & Hutz

[57] ABSTRACT

A process for producing and processing multicomponent mixtures on the basis of reaction plastics provides that the liquid mixture is cooled off to a temperature that allows virtually dry further processing. This is done in that the cooled reaction plastic mixture is shaped as a solid piece from which material is rubbed off while it is applied onto a surface to be coated. The rubbed off material melts on the surface to be coated and hardens within a short period of time.

11 Claims, 2 Drawing Sheets

16
18
12
30
20
24

12
26
28
22
24

PROCESS FOR PRODUCING AND PROCESSING MULTI-COMPONENT MIXTURES ON THE BASIS OF REACTION PLASTICS

BACKGROUND OF INVENTION

The invention relates to a process for producing and processing multi-component mixtures on the basis of reaction plastics, whereby the liquid mixture is cooled off to a temperature that allows virtually dry further processing.

There is a desire for avoiding the kind of disadvantages and limitations that arise during processing of reaction plastics due to the fact that the material can only be processed for a certain period of time - the so-called pot life in the liquid, pasty or deformable state and because, even during this period of time, the processing properties can change significantly.

SUMMARY OF INVENTION

The objective of the present invention is to provide an especially simple process for coating surfaces with reaction plastics, and this objective is achieved according to the invention in that the cooled reaction plastic mixture is shaped as a solid piece from which material is rubbed off while it is applied onto a surface to be coated and, when heated, this material melts and hardens on the surface to be coated.

The invention offers the advantage that, in this manner, reaction plastics, whose processing is critical under the prevailing practical conditions, can be applied to the surfaces to be coated as easily as, for example, ski wax can be applied to skis. Whereas common usage has generally referred to this technique as "waxing", with the process proposed according to the invention, depending on the type of reaction plastics used, very hard, sealed surface coatings are produced, consisting of the reaction plastic which has been processed in the solid state by rubbing, and which has been liquefied in the coating and then reacted.

In principle, this new process is suitable for any type of reaction plastics that, in the past, have been applied in liquid form onto surfaces to be coated, i.e. especially epoxy resins, methacrylate resins, polyurethane resins, silicon resins and polyester resins. In the process according to the invention, the preferably cold-reactive liquid reaction plastics are first cooled off to such an extent that their reaction is inhibited. In a preferred embodiment of the process, these plastics are cooled off by cryogenic liquefied gas, e.g. liquid nitrogen and, according to a first preferred alternative, the liquid plastic is solidified in a liquefied gas bath after having been mixed and reacted with the addition of, for example, accelerators, retarders, leveling agents, pigments, hydrophobic or hydrophilic additives or optionally fillers of any desired formulation. As a result of the hardening process that occurs there and as a result of the technique by means of which the liquid plastic is cast or sprayed into the bath, solid particles of certain sizes are formed, which will be referred to as pellets below. According to the preferred embodiment of the process according to the invention, the pellets are pressed together or sintered to form larger, integrated pieces and subsequently, the amount of material needed for the coating is rubbed off these pieces by means of abrasion contact with the surface to be coated. The above-mentioned pressing or sintering procedure makes it possible to influence the tensile strength, resistance to compression and abrasion resistance of the pieces molded in the desired shape.

In another embodiment, the process according to the invention can also be carried out in such a way that the liquid reaction plastic of a certain formulation is cast into a mold that is cooled, for example, by cryogenic liquefied gas and it is then rapidly hardened to form the desired molded piece. Even when this piece is not made of sintered pellets, like in the first case, it can be used to apply material to the surface to be coated by means of abrasion contact and, as described above, this leads to a hardened plastic coating via the liquid phase.

In order for the solid piece from which the coating material is rubbed to remain cold and hard during an application procedure that is time-consuming, this piece is preferably clamped in a cooled holding device. The invention also comprises such novel holding and guiding devices having cooling chambers for use during the application of a coating material.

THE DRAWINGS

DETAILED DESCRIPTION

Figure 1:
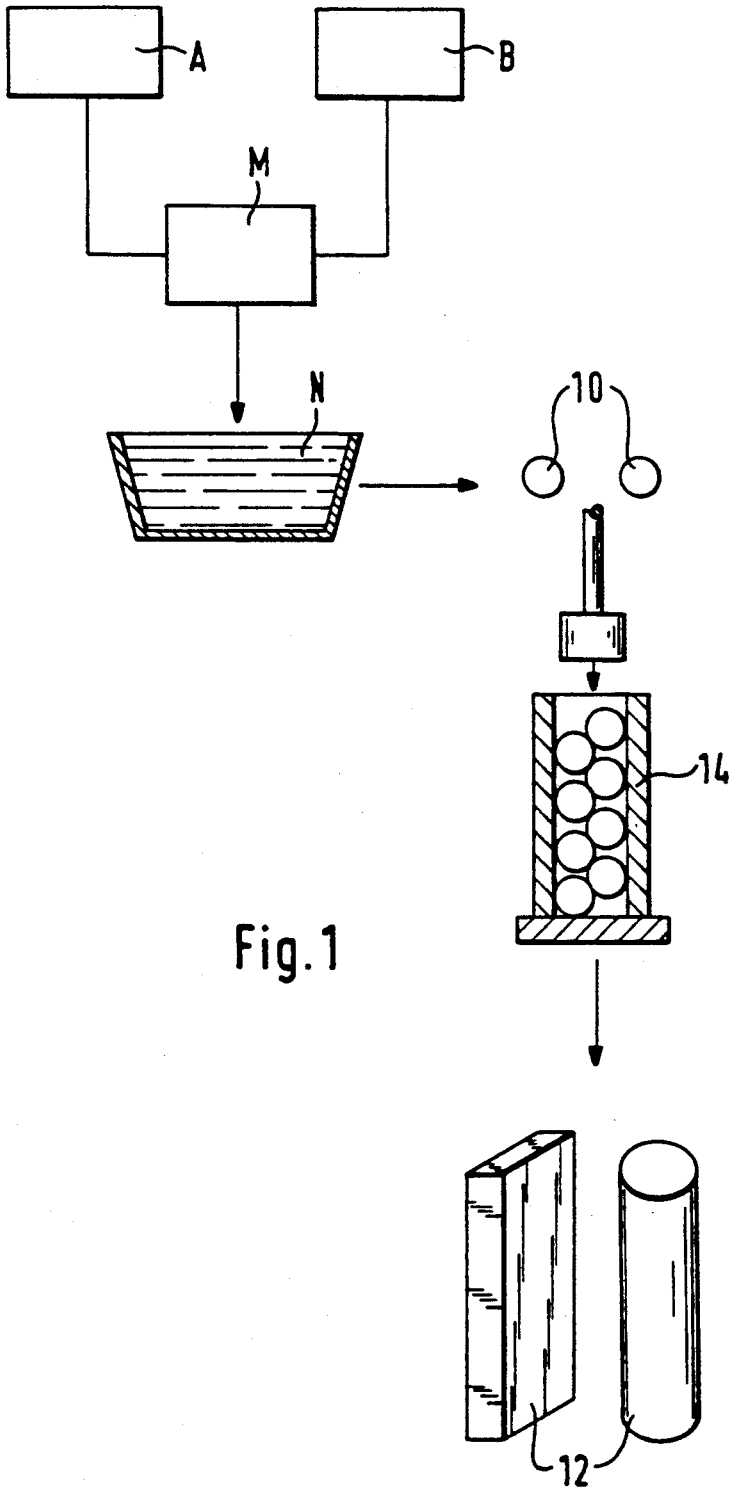
FIG. 1 is a schematic representation of the manufacturing process of a molded piece, which can be used to coat a surface.

The manufacturing process shown in FIG. 1 starts with the resin and hardener components A, B being mixed together with additional substances optionally included in the desired formulation. The reaction of mixture M is inhibited by being cast or sprayed into a bath of liquid nitrogen N. This hardening procedure produces grains or pellets 10, that can be stored almost indefinitely in a cooled state.

In the next step, first of all, the pellets 10 are pressed into an appropriate mold 14 and are thus sintered together, so as to form larger pieces 12, e.g. blocks or cylinders. Therefore, in the embodiment shown, the solid pieces 12 are sintered pieces with a grainy structure. They can optionally, as described above, also be made as cast pieces with a homogeneous structure. The molded pieces 12 can be stored indefinitely in a cooled state, thus remaining dimensionally stable.

Figure 2:
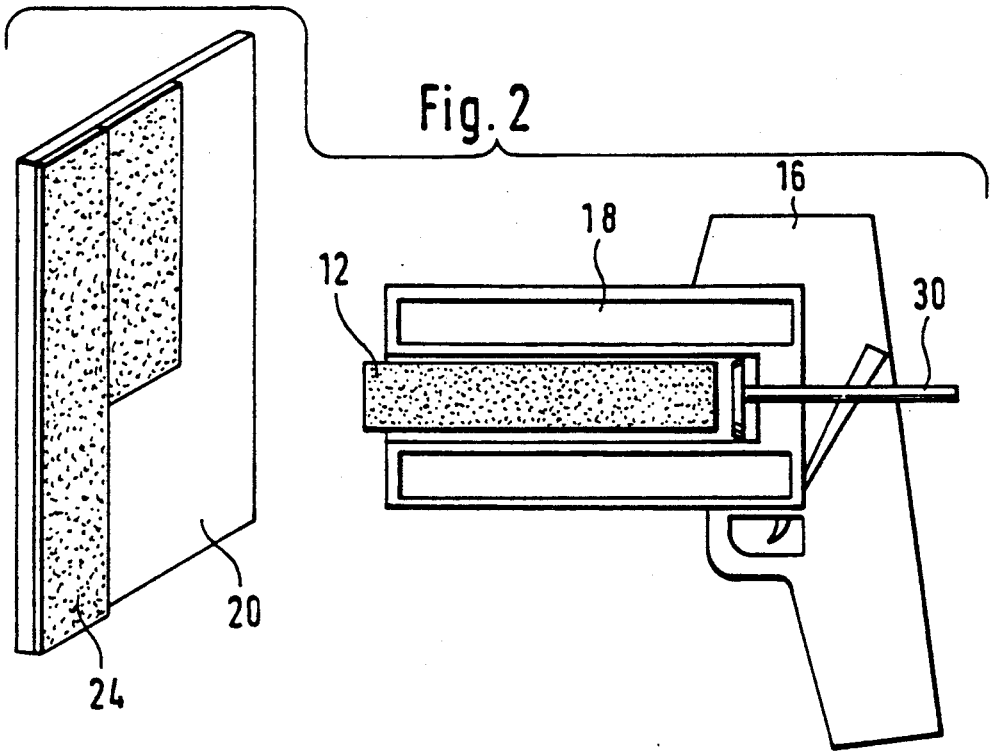
FIG. 2 illustrates a holding device having cooling chambers to hold a molded piece according to FIG. 1.
Figure 3:
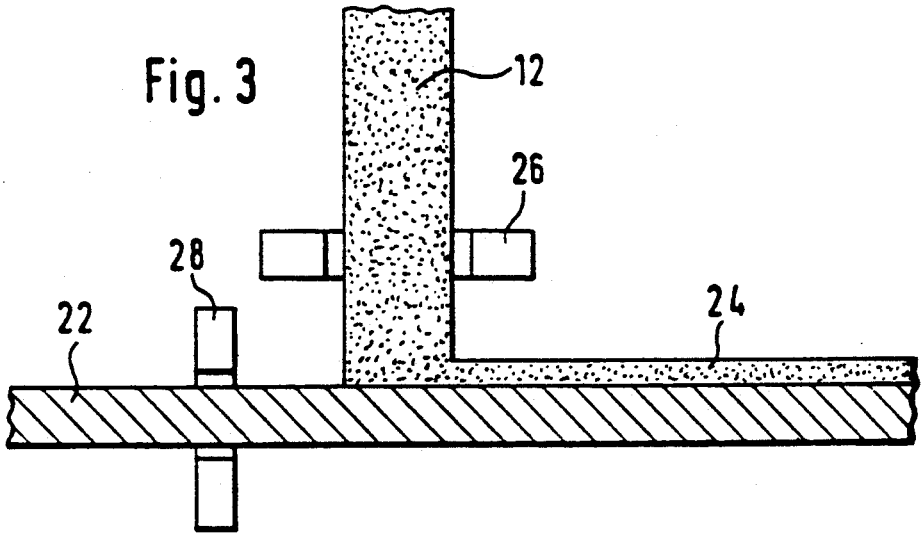
FIG. 3 illustrates a molded piece according to FIG. 1 in abrasion contact with a surface to be coated.

FIGS. 2 and 3 show the new application process for coating surfaces with liquid reaction plastic. According to FIG. 2, the molded piece 12 is held, in the example, in a gun-shaped holding device 16, which is equipped with one or more coolant chambers 18, into which a cryogenic liquefied gas, solid $CO_2$ or another coolant can be placed. In the sample case, the coolant chamber 18 surrounds the frozen liquid-plastic molded piece 12 and prevents premature thawing.

For coating, for example, a wall surface 20, a floor surface 22, a tube, a tank wall or any other surface, the molded piece 12 is pressed against the surface to be coated and rubbed along it. This produces an applied surface layer 24, similar to the application of a layer of wax. However, since these are reaction plastics, the material applied forms a relatively uniform liquid film and hardens as it completes its reaction.

If desired, the temperature conditions during the application procedure can be controlled and regulated, as shown in FIG. 3 for example, in that a cooling device 26 moves along and keeps the temperature of the frozen piece of reaction plastic 12 below a certain limit value and/or in that a heating device 28 warms the surface to be coated up to a certain minimum temperature.

Since the molded piece 12 gets shorter and shorter from abrasion, in the example, the holding device 16 has a mechanical feed device 30 which pushes the molded piece 12 forward step by step out of the cooled guide or holding device, so that its front free end can be pressed against the surface to be coated 20 or 22.

It is obvious that the type and size of the holding device 16 depends on whether small or large surfaces are to be coated either manually or mechanically. As a matter of principle, the new process is suitable either for tradesmen who, for example, have to repair just individual spots in coatings or to apply an abrasion-proof coating on small surfaces, or else for industrial-scale production of, for instance, plates with a certain coating. Another embodiment is the application of road markings, for example, by means of a mobile holding device. Finally, mention should also be made of the coating of fabrics, since the liquefaction of the reaction plastic during the application procedure can waterproof the fabric.

It is evident that the temperature to be maintained, the contact pressure of the molded piece 21 against the surface to be coated, the abrasion speed and other parameters depend on the individual application case and on the reaction plastic being used. The measures that have to be taken to achieve optimum working conditions depend on all of these factors.

In simple cases, it can even be sufficient to take a molded piece 12 out of the cooled holding device and, without any further cooling, to rub it along a surface to be coated or else to process it in a holding device that is only equipped with thermal insulation rather than with coolant chambers.

What is claimed is:

1. Process for the production of a molded part made of unset multi-component mixtures on the basis of reaction plastics, the improvement being in that the components and any additives are mixed in the liquid state, the liquid is cooled off to a temperature at which the liquid solidifies to form particles but no reaction occurs, the particles are formed into an object while maintaining a temperature below the curing temperature, the objects are kept below the curing temperature until they are processed, during or after the cooling, the reaction plastic mixture is first shaped as small, hard grains, which are pressed together to form larger, integrated pieces from which the material that serves as coating material is then rubbed off, and the liquid reaction mixture is converted into the solid aggregate state by means of cryogenic liquid gas.

2. Process according to claim 1, characterized in that the liquid reaction plastic mixture is solidified by means of casting or spraying into a liquefied gas bath.

3. Process according to claim 1, characterized in that the liquid reaction plastic mixture is solidified into a mold cooled by liquefied gas.

4. Process according to claim 1, characterized in that the solid piece from which the material that serves as coating material is rubbed off is kept cool during the rubbing process.

5. Process for the production of a molded part made of unset multi-component mixtures on the basis of reaction plastics, the improvement being in that the components and any additives are mixed in the liquid state, the liquid is cooled off to a temperature at which the liquid solidifies to form particles but no reaction occurs, the particles are formed into an object while maintaining a temperature below the curing temperature, the objects are kept below the curing temperature until they are processed, and the liquid reaction mixture is converted into the solid aggregate state by means of cryogenic liquid gas.

6. Process for the production of a molded part made of unset multi-component mixtures on the basis of reaction plastics, the improvement being in that the components and any additives are mixed in the liquid state, the liquid is poured into a bath of deep-frozen liquid in which the liquid solidifies to form particles but not reaction occurs, the particles are formed into an object while maintaining a temperature below the curing temperature, and the objects are kept below the curing temperature until they are processed.

7. Process according to claim 6, characterized in that, during or after the cooling, the reaction plastic mixture is first shaped as small, hard grains, which are pressed together to form larger, integrated pieces from which the material that serves as coating material is then rubbed off.

8. Process according to claim 6, characterized in that the solid piece from which the material that serves as coating material is rubbed off is kept cool during the rubbing process.

9. In a process for producing multi-component mixtures on the basis of reaction plastics including the steps of mixing the components of the mixture together in the liquid state, feeding the liquid components into a deep-frozen liquid medium before the reaction of the components initiated by the mixing step is completed, interrupting the reaction and forming small particles by freezing the liquid components when the liquid components are fed into the deep-frozen liquid medium, compressing the small particles to form a solid object while maintaining a temperature below the curing temperature of the components, and maintaining the object at the below curing temperature until the object is processed and during the subsequent processing.

10. Process according to claim 9, characterized in that the object is processed by rubbing the object against a surface while raising the temperature to at least the curing temperature.

11. In a process for coating a surface with multi-component mixtures on the basis of reaction plastics, the improvement being contacting the surface with a molded object made of unreacted plastics cooled with a deep-frozen liquid by pouring the unreacted reaction plastics in a bath of deep-frozen liquid, and applying heat to the contact site to generate a curing of the reaction plastics.

* * * * *